US005411057A

United States Patent [19]

Pouchot

[11] Patent Number: 5,411,057

[45] Date of Patent: May 2, 1995

[54] DETACHABLE INHALATION VALVE DEVICE FOR A RESPIRATOR FILTER ASSEMBLY

[75] Inventor: Thomas D. Pouchot, Gibsonia, Pa.

[73] Assignee: Mine Safety Appliances Company, Pittsburgh, Pa.

[21] Appl. No.: 796,708

[22] Filed: Nov. 21, 1991

[51] Int. Cl.[6] ..... A62B 7/10; A62B 23/02

[52] U.S. Cl. ..... 137/550; 128/206.17; 128/206.15; 128/205.29

[58] Field of Search ..... 128/201.19, 202.27, 128/205.27, 205.28, 205.29, 206.12, 206.14, 206.15, 206.16, 206.17, 206.21, 207.12; 55/316, 387, 502, 509, 518, DIG. 33; 137/550

[56] References Cited

U.S.-PATENT DOCUMENTS

| | | | |
|---|---|---|---|
| 3,820,959 | 6/1974 | Wise et al. | 28/205.28 X |
| 4,543,112 | 9/1985 | Ackley et al. | 128/206.15 |
| 4,793,342 | 12/1988 | Haber et al. | 128/206.12 |
| 5,033,507 | 7/1991 | Pouchot | 128/206.17 X |
| 5,036,844 | 8/1991 | Pouchot et al. | 128/206.17 |
| 5,080,094 | 1/1992 | Tayebi | 128/205.29 |

*Primary Examiner*—Vincent Millin
*Assistant Examiner*—William M. Pierce
*Attorney, Agent, or Firm*—Reed Smith Shaw & McClay

[57] ABSTRACT

A respirator filter assembly for use in a respirator apparatus wherein the assembly includes a respirator filter cartridge having a housing which contains filter material and has an inlet portion and an outlet portion, and a valve device that is selectively securable to an opening of the inlet portion, the outlet portion of the housing being preferably securable to respirator structure such as a face mask. The valve device preferably comprises a valve support member and a one-way valve element. The support member is provided with means for detachably securing the valve device over the inlet portion whereby the valve element is situated to regulate the inlet opening. The support member also desirably has a means for connecting the support member to the respirator apparatus, preferably the filter cartridge, such that the valve device may reside in a position so as not to obstruct the filter cartridge inlet opening when the valve device is not attached to the inlet portion.

20 Claims, 2 Drawing Sheets

DETACHABLE INHALATION VALVE DEVICE FOR A RESPIRATOR FILTER ASSEMBLY

FIELD OF THE INVENTION

The present invention relates in general to a filter assembly for a respirator and, more particularly, to a filter assembly having a detachable inhalation valve device.

BACKGROUND OF THE INVENTION

In instances where work is performed in a contaminated environment by workers wearing respirators, the workers typically exit the contaminated area by passing through one or more cleanup areas or decontamination zones. Often the workers continue to wear their respirators in the cleanup areas. This practice, however, presents the risk that contaminated matter, drawn into the filter of the respirator during use, may fall out of the filter and into the cleanup area, or even into the clean environment beyond the cleanup area. Heretofore, to avoid this problem, wearers of such respirators would sometimes plug up or tape up the filter to prevent contaminants from falling out. In doing this, however, the worker blocked the air flow through the filter whereby the worker could no longer use the respirator. As a result, the worker would have to remove the respirator at an earlier point in the decontamination process than would otherwise be desirable. Alternatively, the worker would, after plugging up the filter, have to hold his breath until he was sufficiently decontaminated to safely remove the respirator.

U.S. Pat. Nos. 4,548,626 and 4,543,112 each describe a respirator assembly including a respirator filter having a one-way valve permanently attached to the intake of the filter, the valve being operable to permit ingress of inhaled air and prevent discharge of exhaled air therethrough. Both of these cover assemblies effectively perform their intended functions, i.e., permitting respiration while preventing contaminated material from falling from the respirator filter during decontamination of the worker. With such a construction, however, resistance to air flow through the respirator filter is increased by virtue of the energy required to open the one-way valve upon each inhalation.

It is also known, as described in U.S. Pat. No. 4,850,346, to provide at least one valve fitting in a respirator face mask wherein the valve fitting includes a one-way valve and is specifically constructed and arranged to detachably receive the outlet of a respirator filter. Hence, if the mask is to be used, a respirator filter must be secured to the mask via the valve fitting. As a result, at all times during use the wearer must overcome not only the inherent air resistance of the filter material but also that of the one-way valve supported in the face mask.

U.S. Pat. Nos. 5,036,844 and 5,033,507 show removable cover assemblies for respirator filters, the former having a one-way valve permanently mounted in the cover while the latter has no such valve. While both of these filter assemblies enable the filter to easily be replaced by removing the cover, the '507 patent always has the one-way valve in the air flow path during use.

An advantage exists, therefore, for a respirator apparatus which simultaneously is lightweight, provides no additional air flow resistance in excess of that of the respirator filter material during normal usage conditions, and, during worker decontamination situations, permits respiration to continue while effectively preventing contaminated material from falling from the filter.

SUMMARY OF THE INVENTION

The present invention generally provides a respirator filter assembly comprising a respirator filter cartridge having a housing which contains filter material and has an inlet portion and an outlet portion, and a valve device that is selectively securable to the inlet portion, the outlet portion of the housing being preferably securable to a respirator structure such as, for example, a face mask. The valve device preferably comprises a valve support member and a valve element. The valve support member is provided with a securing means for detachably securing the valve device over the inlet portion whereby, the valve device may reside in an operative mode, i.e., the valve element is situated to regulate an inlet opening in the inlet portion, such as may be required during a worker decontamination procedure. The valve support member also desirably has an attachment means for connecting the support member to the respirator apparatus, preferably the filter, wherein the valve device may reside in a nonoperative mode, i.e., when the valve element does not in any way obstruct the filter inlet opening, such as during normal respiratory situations in which the worker is working in the contaminated area. The valve device is extremely light in weight and can be carried continuously as part of the respirator assembly both in the operative or nonoperative modes.

When a user wearing a respirator apparatus provided with a respirator filter assembly constructed according to the present invention exits a contaminated environment, the user quickly and easily places the detachable valve device over the normally unobstructed inlet opening of the respirator filter cartridge housing, whereby any air drawn into the respirator will pass through the valve element disposed in the cartridge inlet opening. This design effectively assures that no contaminated particulate matter from the filter can escape through the filter cartridge housing. In other words, air is allowed to flow into the filter via the valve element while, simultaneously, any contaminated matter falling out of the filter is trapped within a pocket formed substantially by a front wall of the housing and the front surface of the filter material. Also, the valve element prevents water from being drawn into the filter. This arrangement allows the user to continue to use the respirator while he is in a cleanup area while at the same time preventing contamination of the cleanup area with the contaminated contents of the filter. It further allows the respirator filter assembly to be handled, stored and transported easily in a clean environment without the need for its decontamination after every use.

In accordance with the present invention, due to the design of the valve support member, the valve element is automatically properly positioned in relation to the filter whenever the valve device is placed into its operative mode. Thus, not only is initial placement of the valve device very easy, but continued alignment of the valve element with the filter is assured. Preferably the valve element is a one-way valve. The compactness and light weight of the respirator filter assembly is also a distinct advantage in terms of handling and storage.

Other details, objects and advantages of the present invention will become apparent as the following description of the presently preferred embodiments and presently preferred methods of practicing the invention proceeds.

BRIEF DESCRIPTION OF THE DRAWINGS

The invention will become more readily apparent from the following description of preferred embodiments thereof shown, by way of example only, in the accompanying drawings, wherein.

DETAILED DESCRIPTION OF THE INVENTION

Figure 1:
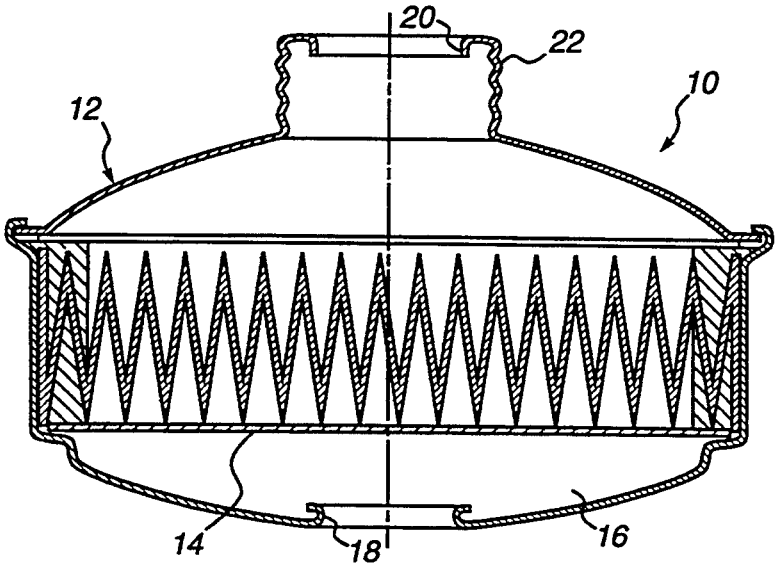
FIG. 1 is a elevational section view of an embodiment of a filter cartridge suitable for use in a respirator filter assembly of the present invention.
Figure 2:
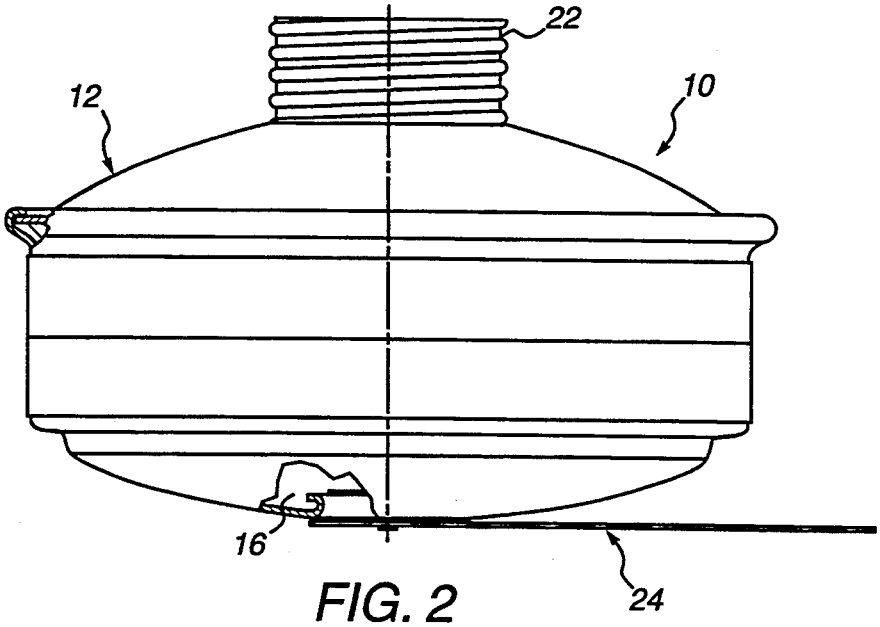
FIG. 2 is an elevational view, in partial section, of a respirator filter assembly constructed in accordance with the present invention including the filter cartridge of FIG. 1 and a preferred embodiment of a detachable inhalation valve device engaged in an inlet opening thereof.

Looking to the drawing figures, particularly to FIGS. 1 and 2, there is shown a respirator filter cartridge 10 including a housing 12 which encloses a filter 14 that may be formed of any suitable filter material. The housing 12 has an inlet portion in the form of a particulate matter retaining forepart 16 including opening 18 and an outlet portion including opening 20. The outlet portion may be provided with any suitable and conventional means, such as, for example, threading 22, for facilitating attachment of the cartridge 10 to respirator apparatus structure including, but not limited to, a face mask (not illustrated). As seen in FIG. 2, inlet opening 18 is suitably dimensioned to receive, at appropriate times, a valve device 24, the details of a presently preferred embodiment of which will be described in greater detail hereinafter.

Under normal use situations, such as when a user is working in a contaminated environment and wearing a respirator apparatus fitted with cartridge 10, the inlet opening 18 remains unobstructed in the manner of FIG. 1, whereby essentially the only resistance to air flow that the user experiences is that resulting from the filter material of filter 14. Whereas, in instances wherein the user must leave the contaminated area yet also be assured that contaminated material that may have become dislodged from the filter does not pass from forepart 16 through the inlet opening 18, the valve device 24 is placed over and engages with the inlet opening as depicted in FIG. 2. In such state, respiration is maintained while any loose material within the housing 12 is effectively trapped in the forepart of the housing between the front of the filter 14 and the valve device 24.

While the respirator filter cartridge 10 of FIGS. 1–2 is shown as a single unit, it is evident that a filter cartridge with a detachable cover assembly, such as is shown in U.S. Pat. No. 5,033,507, could also be used in the present invention.

Looking now to FIGS. 3–8, there are shown the details of a presently preferred embodiment of the valve device 24 which cooperates with filter cartridge 10 to produce a respirator filter assembly of unique and advantageous construction. Valve device 24 desirably includes a valve support member 26 preferably fabricated from plastic so as to produce a valve element cooperative portion 28 and a respirator structure engagement portion 30. Valve element cooperative portion 28, as is perhaps best appreciated with reference to FIGS. 5 and 6, preferably comprises a first radially outwardly directed flange 32 lying in a first plane, an annular wall 34 projecting substantially transversely from one side of the first flange, a second radially inwardly directed second flange 36 lying in a plane substantially parallel to the first plane, a central hub member 38 lying substantially in the same plane as the second flange and a plurality of radially disposed vanes 40 connecting the central hub member 38 to the annular wall 34 and second flange 36.

Provided generally at the juncture of annular wall 34 and second flange 36 are means for engaging the inlet opening 18 of housing 12. The means for engaging preferably comprise a plurality of (most desirably three) protuberances 42 which project a distance d (FIG. 7) from the radially exterior side of annular wall 34 and which, through their own engageability with the interior of inlet opening 18 and the engageability of the first flange 32 with the exterior of the inlet opening 18 (FIG. 2), permit the valve support member 26 to be detachably secured to the housing 12 by a snap-in, snap-out connection.

As previously stated, the valve support member also is formed with an attachment means 30 for engaging a respirator structure. In accordance with the preferred embodiment of the present invention depicted in the drawing figures, this attachment means preferably includes a pair of spaced-apart gripping members 44 which together define a substantially circular opening of a dimension sufficient to grippingly yet releasably receive the threaded region 22 of the outlet portion of the filter cartridge housing 12. The gripping members 44 converge at a neck portion 46 of the valve support member 26 whereat they merge with, are of substantially the same thickness as and lie in substantially the same plane as the first flange 32. As a result, due to the relative thinness of the griping members 44, they are sufficiently resilient to be easily snapped on and off the threaded outlet portion 22 of the .cartridge housing 12. Although for optimum compactness, weight and maintenance/replaceability considerations, the attachment means 30 for engaging the respirator structure preferably assumes the general configuration of the gripping members 44 depicted in the drawing figures, it is also contemplated that the means for engaging may assume any suitable form which can permanently or releasably attach the valve support member 6 to any respirator structural component including, inter alia, the filter cartridge 10 or the respirator face mask.

Figure 8:
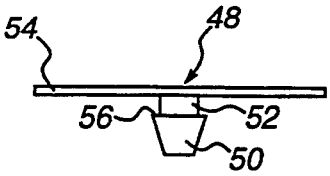
FIG. 8 is an elevational view of a preferred embodiment of the valve element adapted for use in the detachable inhalation valve of the respirator filter assembly of the present invention.
Figure 3:
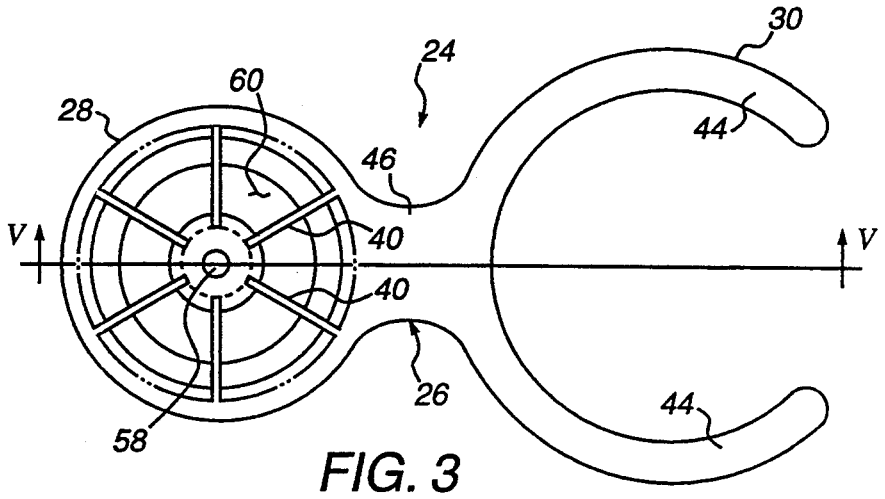
FIG. 3 a view of one side of a valve support member of the valve device shown in FIG. 2 with the valve element thereof omitted for clarity.
Figure 4:
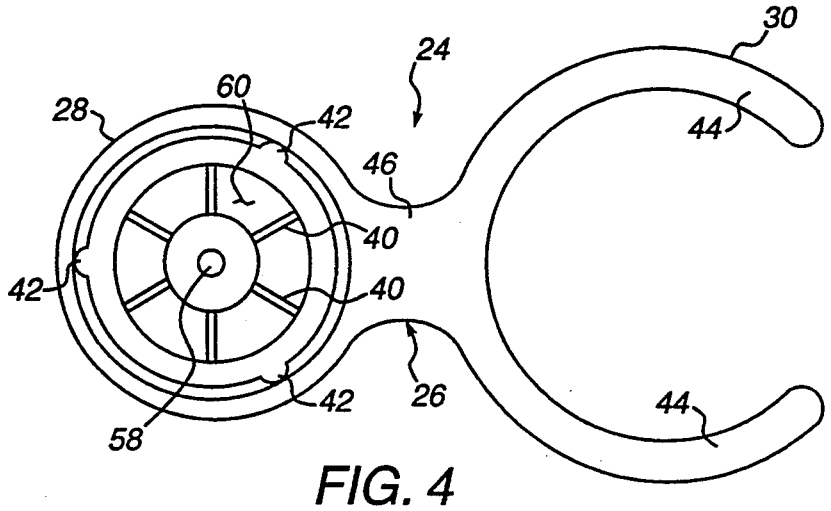
FIG. 4 is a view of an opposite side of the valve support member shown in FIG. 3.
Figure 5:
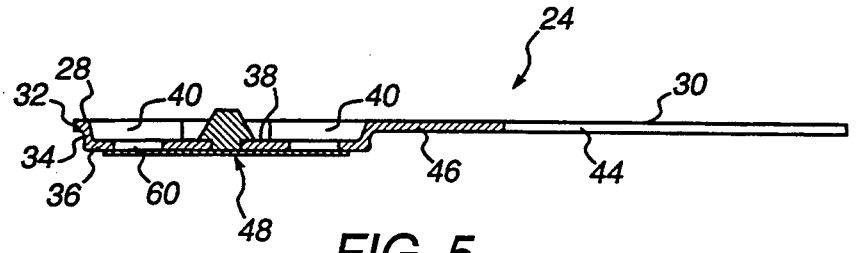
FIG. 5 is a sectional view of the valve support member taken along line V—V of FIG. 3 with a preferred embodiment of a valve element, also shown in section, in operable engagement therewith.
Figure 6:
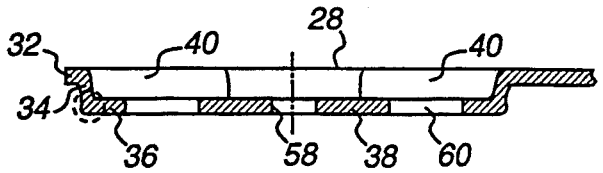
FIG. 6 is an enlarged view of a valve element cooperative portion of the valve support member.
Figure 7:
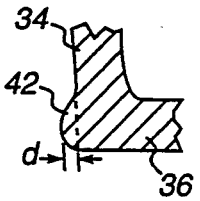
FIG. 7 is an enlarged detail view of the circled portion of FIG. 6.

Looking to FIGS. 5 and 8, there is shown a preferred embodiment of valve element 48 suitable for use with the valve support member 26. The valve element 48 is preferably a flapper valve fabricated as a single piece of highly resilient material such as rubber, neoprene, or the like. Its essential components include a generally frustoconical detent member 50, a shaft portion 52 and a thin flap-like disk 54, wherein the frustoconical detent member is situated at one end of the shaft portion and forms a shoulder 56 relative thereto and the disk 54 is located at the opposite end of the shaft portion 52.

Securement of the valve element 48 to the valve support member 26 is achieved by insertion of the frustoconical detent member 50 through an aperture 58 provided therefor in the central hub member 38. Aperture 58 is of smaller diameter than shoulder 56 whereby upon the application of sufficient force to the valve element 48, the detent member 50 compresses as it passes through the aperture 58. Upon completion of its passage, the detent member 50 re-expands such that the shoulder 56 positively latches the valve element 48 into engagement with the valve element cooperative portion 28 of the valve support member 26. In such condition, the thin disk 54 overlies an annular air flow passage 60 existing between the central hub 38 and the second flange 36. Hence, when the valve device is in its operative position as illustrated in FIG. 2, the inhalation of the user causes air to enter the filter cartridge via the annular air flow passages 60, thereby displacing the thin disk 54 so as to permit the inhaled air to pass through the filter material and proceed to the user through outlet opening 20. Upon exhalation, the flap 54 returns to its normal position covering the annular passages 60 and is positively retained there by the pressure of the exhaled breath. In addition, the respirator apparatus to which the respirator filter assembly is attached is provided with suitable means to vent the user's exhaled breath.

Constructed as described hereinabove, the detachable valve device 24 is an inexpensive, rugged and reliable instrument that weighs a fraction of an ounce and which enables a user to conveniently carry the device in the immediate vicinity of the respirator apparatus without being cognizant of or encumbered in any way by its weight or bulk. Equally as important, its detachability permits a user to employ the valve device entirely at the user's discretion. Hence, the user can choose to leave the valve device in its detached, nonoperative position during normal working conditions in a contaminated environment, thereby leaving the filter cartridge housing inlet opening completely unobstructed. With the valve device so disposed, any resistance to air flow that the user experiences is due essentially to the inherent air flow resistance of the filter material itself and, to a lesser degree, any airborne matter which may have become trapped by the filter material. Thus, under normal working conditions, the user does not experience any additional physical burden related either to the weight of the valve device or to effecting its operation, i.e., overcoming its inherent resistance to air flow. However, should the user find need to exit the contaminated working environment, he or she simply snaps the valve device into its operative position whereby respiration can continue while the loss of contaminated material from the filter cartridge is prevented.

Although the invention has been described in detail for the purpose of illustration, it is to be understood that such detail is solely for that purpose and that variations can be made therein by those skilled in the art without departing from the spirit and scope of the invention except as it may be limited by the claims.

What is claimed is:

1. A valve device adapted for use with a respirator filter cartridge comprising a filter within a housing, said housing having an outlet opening and a particulate matter retaining forepart including an inlet opening, said valve device comprising:

a valve support member including a securing means for detachably connecting said support member to said inlet opening; and a valve element carried by said valve support member for regulating air flow into said inlet opening.

2. The valve device of claim 1 wherein said support member further includes an attachment means for connecting said support member to a respirator structure.

3. The valve device of claim 2 wherein said attachment means connects said support member to said respirator filter cartridge.

4. The valve device of claim 3 wherein said attachment means comprise means for enabling detachable connection of said valve device to said respirator filter cartridge.

5. The valve device of claim 2 wherein said attachment means comprise means for enabling detachable connection of said valve device to said respirator structure.

6. The valve device of claim 1 wherein said securing means include a means for enabling snapping of said support member into and out of engagement with said inlet opening.

7. The valve device of claim 1 wherein said support member includes a passage for permitting air flow therethrough and into said inlet opening.

8. The valve device of claim 7 wherein said valve element comprises a one-way valve operable to permit passage of air through said passage and into said inlet opening upon inhalation by a user and to prevent egress of a user's exhalation breath through said passage.

9. The valve device of claim 7 wherein said one-way valve is a flapper valve.

10. The valve device of claim 9 wherein said flapper valve includes a resilient disk for covering said passage.

11. A respirator filter assembly comprising:

a respirator filter cartridge comprising a filter within a housing, said housing having an outlet opening and a particulate matter retaining forepart including an inlet opening; and a valve device comprising:

a valve support member including a securing means for detachably connecting said support member to said inlet opening; and a valve element carried by said valve support member for regulating air flow into said inlet opening.

12. The assembly of claim 11 wherein said support member further includes an attachment means for connecting said support member to a respirator structure.

13. The assembly of claim 12 wherein said attachment means connects said support member to said respirator filter cartridge.

14. The assembly of claim 13 wherein said attachment means comprise means for enabling detachable connection of said valve device to said respirator filter cartridge.

15. The assembly of claim 12 wherein said attachment means comprise means for enabling detachable connection of said valve device to said respirator structure.

16. The assembly of claim 11 wherein said securing means include a means for enabling snapping of said support member into and out of engagement with said inlet opening.

17. The assembly of claim 11 wherein said support member includes a passage for permitting air flow therethrough and into said inlet opening.

18. The assembly of claim 17 wherein said valve element comprises a one-way valve operable to permit passage of air through said passage and into said inlet opening upon inhalation by a user and to prevent egress of a user's exhalation breath through said passage.

19. The assembly of claim 17 wherein said one-way valve is a flapper valve.

20. The assembly of claim 19 wherein said flapper valve includes a resilient disk for covering said passage.

* * * * *